US009136651B2

(12) United States Patent
Xuan et al.

(10) Patent No.: US 9,136,651 B2
(45) Date of Patent: Sep. 15, 2015

(54) ELECTRICAL CONNECTOR HAVING LIGHT PIPE AND LED WITH OVER MOLDED OPAQUE LAYER

(71) Applicant: HON HAI PRECISION INDUSTRY CO., LTD., New Taipei (TW)

(72) Inventors: Wan-Li Xuan, Kunshan (CN); Dao-Kuan Zhang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 30 days.

(21) Appl. No.: 14/161,913

(22) Filed: Jan. 23, 2014

(65) Prior Publication Data

US 2014/0213100 A1 Jul. 31, 2014

(30) Foreign Application Priority Data

Jan. 28, 2013 (CN) ..... 2013 1 0029445

(51) Int. Cl.
*H01R 3/00* (2006.01)
*H01R 13/717* (2006.01)
*H01R 13/641* (2006.01)

(52) U.S. Cl.
CPC ..... *H01R 13/7175* (2013.01); *H01R 13/641* (2013.01); *H01R 13/7172* (2013.01)

(58) Field of Classification Search
CPC ..... H01R 13/7175
USPC ..... 439/490
See application file for complete search history.

(56) References Cited

U.S. PATENT DOCUMENTS

| | | | | |
|---|---|---|---|---|
| 3,082,395 | A * | 3/1963 | Madansky | 439/57 |
| 3,132,811 | A * | 5/1964 | Madansky | 362/632 |
| 3,183,344 | A * | 5/1965 | Madansky | 362/632 |
| 5,786,239 | A * | 7/1998 | Ohsawa et al. | 438/123 |
| 5,876,239 | A | 3/1999 | Morin et al. | |
| 6,352,446 | B2 | 3/2002 | Ezawa et al. | |
| 6,368,159 | B1 | 4/2002 | Hess et al. | |
| 6,520,799 | B1 | 2/2003 | Cheng et al. | |
| 6,554,638 | B1 | 4/2003 | Hess et al. | |
| 6,962,511 | B2 | 11/2005 | Gutierrez et al. | |
| 7,241,181 | B2 | 7/2007 | Machado et al. | |
| 7,249,966 | B2 | 7/2007 | Long | |
| 2008/0265181 | A1 * | 10/2008 | Boe | 250/494.1 |

* cited by examiner

*Primary Examiner* — Phuong Dinh
(74) *Attorney, Agent, or Firm* — Ming Chieh Chang; Wei Te Chung

(57) ABSTRACT

An electrical connector (100) includes a mating port (15) for insertion of a plug connector, a first indicating assembly (5) for indicating a communication status of the mating port, and a second indicating assembly (6) for indicating another communication status of the mating port. The first indicating assembly includes a first light pipe (51) extending along the front-to-back direction and a first light emitting diode (52) extending along a top-to-bottom direction. The first LED has a number of first pins for mounting onto an exterior substrate and a first light emitting portion (521). The first light emitting portion has a number of first surrounding walls (5211) over molded with a first opaque layer (71).

13 Claims, 4 Drawing Sheets

ELECTRICAL CONNECTOR HAVING LIGHT PIPE AND LED WITH OVER MOLDED OPAQUE LAYER

BACKGROUND OF THE INVENTION

1. Field of the Invention

The present invention relates to an electrical connector equipped with light pipe and light emitting diode (LED) arrangement for high speed high frequency applications.

2. Description of Related Art

An electrical connector of a prior art design as shown in FIG. 1 has a mating port for a plug connector inserting, a mounting port 16' located behind the mating port, a contact module 2' mounted to the mounting port 16' along a back-to-front direction, a first indicating assembly 5', and a second indicating assembly 6'. The first indicating assembly includes a first light pipe 51' extending horizontally and a first LED 52' extending vertically. The second indicating assembly includes a second light pipe 61' extending horizontally and a second LED 62' extending vertically. Since there is not any light-blocking member between the first and second LEDs, one of the first and second LEDs may emit light that not only transmit to corresponding light pipe but also leak to another light pipe undesirably.

U.S. Pat. No. 7,241,181, issued to Machado et al. on Jul. 10, 2007, discloses an electrical connector comprising a carrier with a row of through holes extending along a top-to-bottom direction, a plurality of LEDs respectively inserted into the holes, and a light pipe assembly including conductive medium adapted to transmit the desired wavelength(s) of light energy from respective LED. Each LED has a lighting section and two pins extending from the lighting section along the top-to-bottom direction. The lighting section of one LED is inserted in a corresponding hole so that it could only emit light to one corresponding light pipe.

An electrical connector having a simple structure is desired.

SUMMARY OF THE INVENTION

Accordingly, an object of the present invention is to provide an electrical connector having a simple structure.

In order to achieve the object set forth, the invention provides an electrical connector comprising a mating port for insertion of a plug connector, a first indicating assembly for indicating a communication status of the mating port, and a second indicating assembly for indicating another communication status of the mating port. The mating port extends along a front-to-back direction. The first indicating assembly includes a first light pipe extending along the front-to-back direction and a first light emitting diode (LED) extending along a top-to-bottom direction. The first light pipe has a first front portion exposed at a visible position and a first tail portion for interacting with a first top face of the first LED. The first LED has a plurality of first pins for mounting onto an exterior substrate and a first light emitting portion including the first top face. The second indicating assembly includes a second light pipe extending along the front-to-back direction and a second LED extending along the top-to-bottom direction. The second light pipe has a second front portion exposed at a visible position and a second contacting portion for interacting with a second top face of the second LED. The second LED has a plurality of second pins for mounting onto the exterior substrate and a second light emitting portion including the second top face. The first light emitting portion has a plurality of first surrounding walls over molded with a first opaque layer. The first and second LEDs need not be mounted to a carrier.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
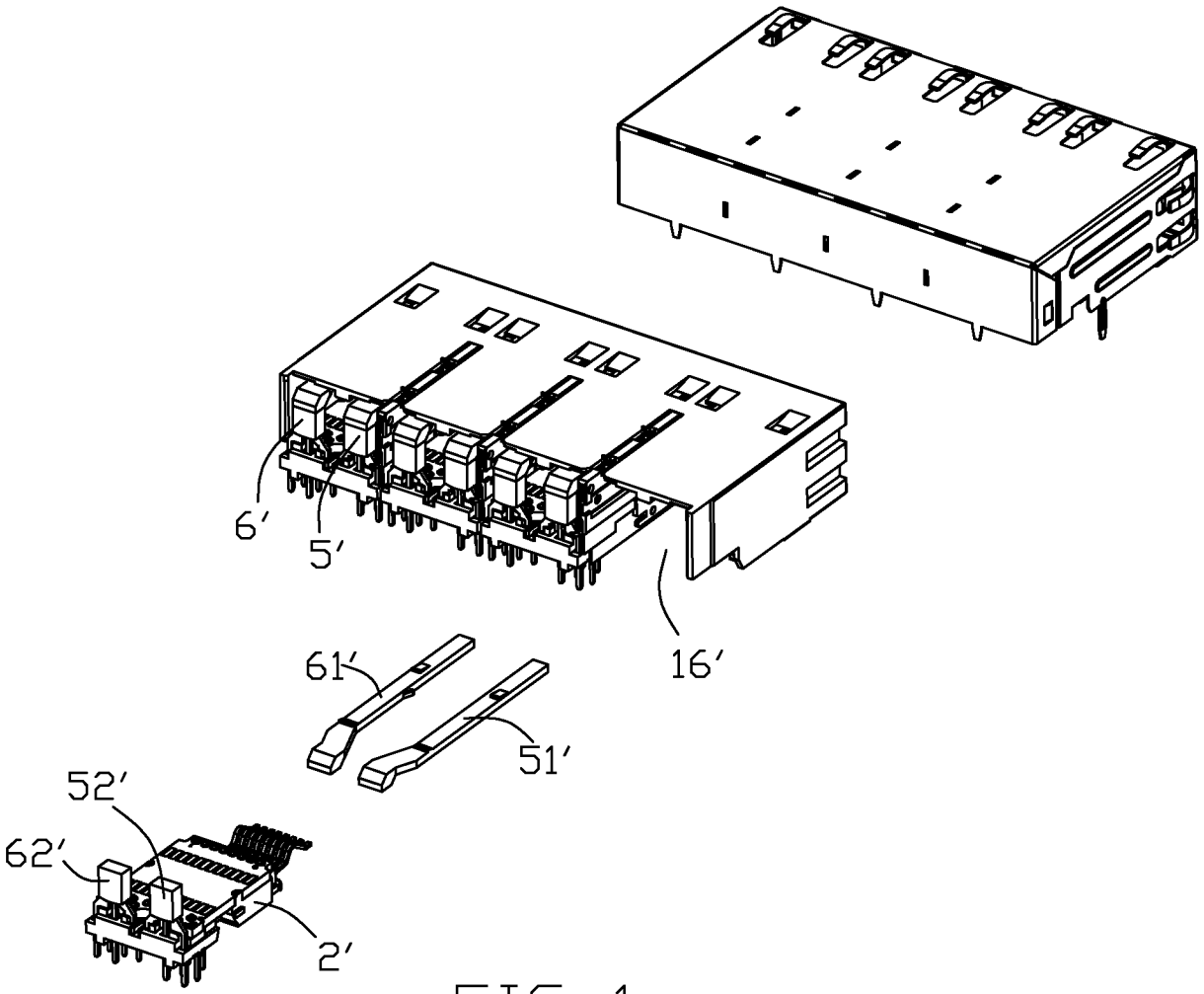
FIG. 1 (PRIOR ART)
FIG. 1 is an exploded view of an electrical connector of a prior art.
Figure 2:
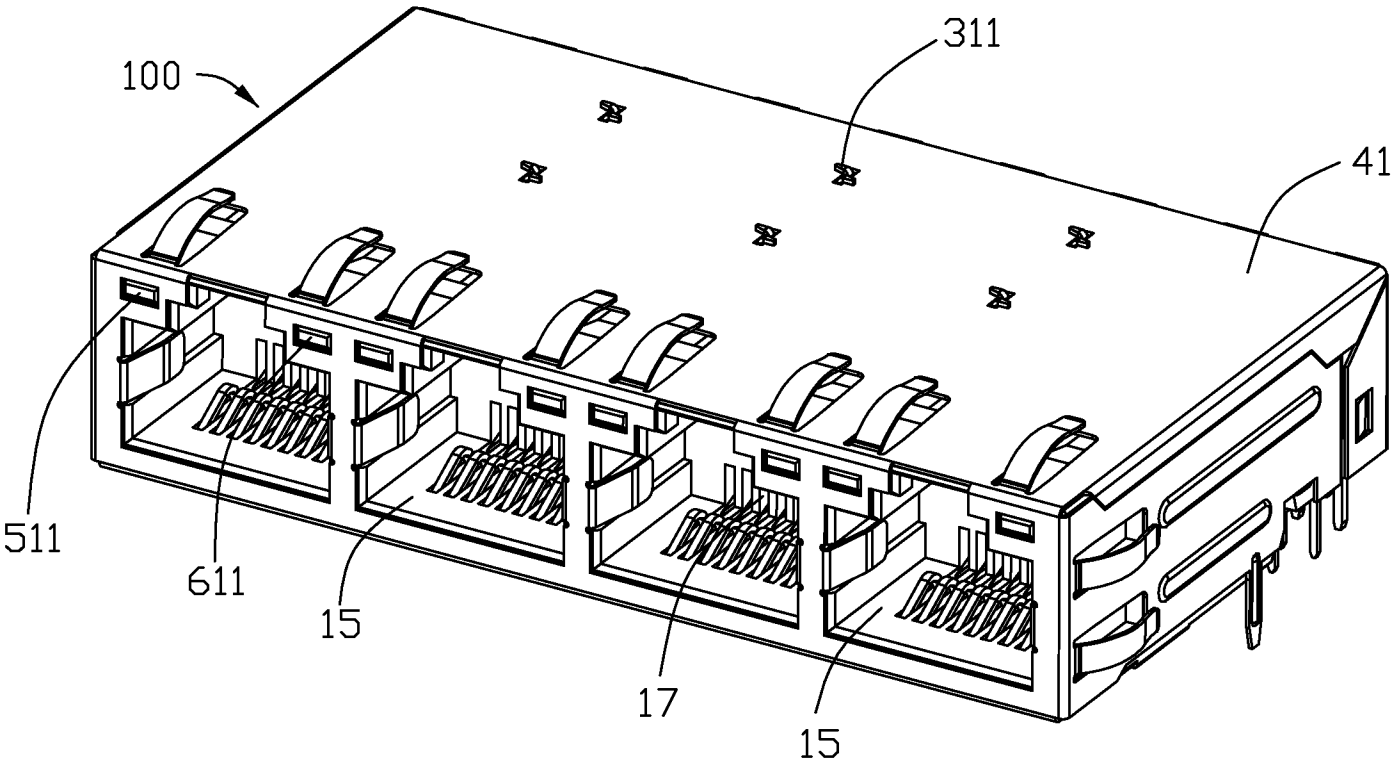
FIG. 2 is a perspective view of an electrical connector according to the present invention.
Figure 3:
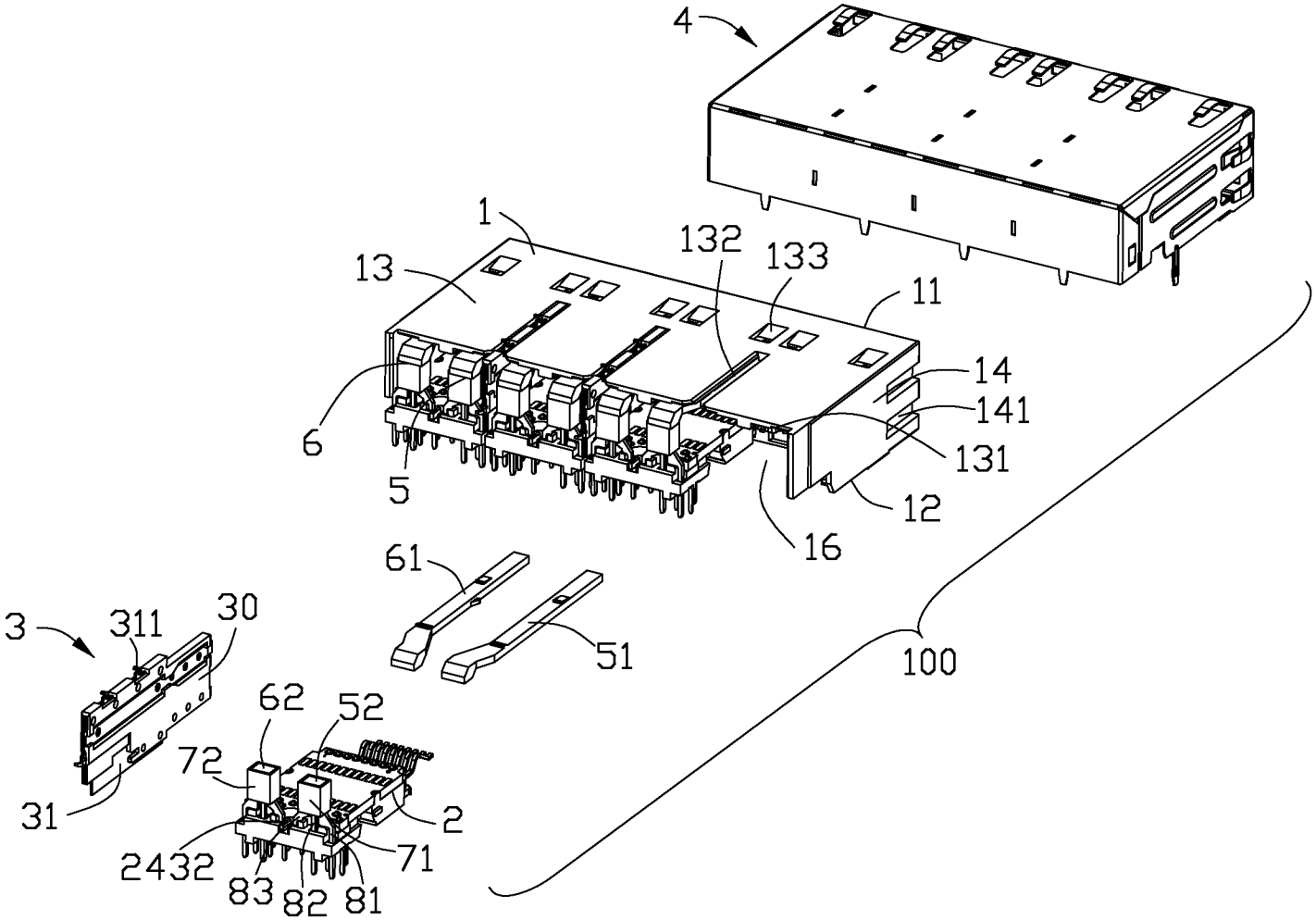
FIG. 3 is an exploded view of the electrical connector shown in FIG. 2.
Figure 4:
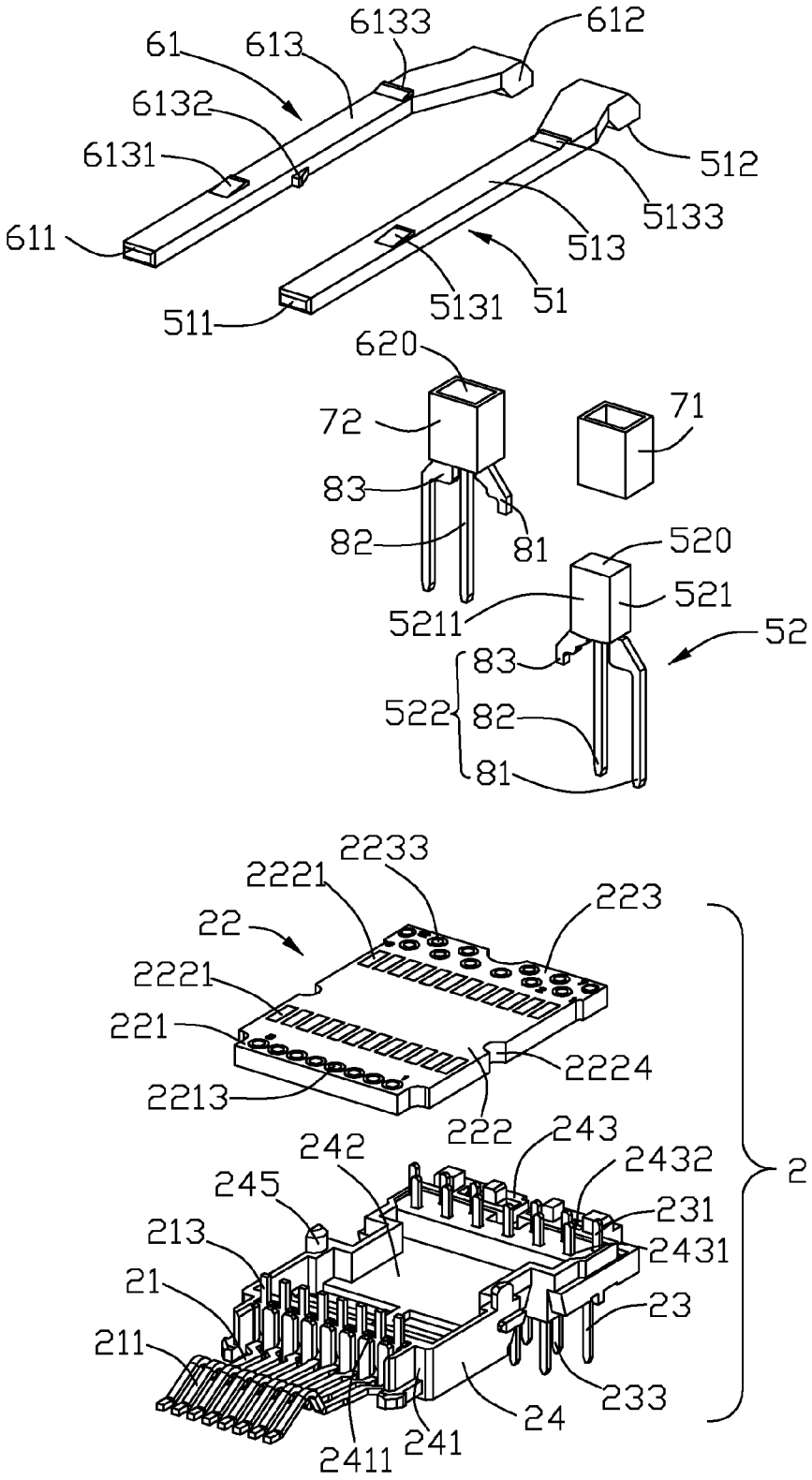
FIG. 4 is an exploded view of a contact module and two indicating assemblies seen in FIG. 3.

Referring to FIGS. 2-4, a 1×4-port electrical connector 100 (modular jack) according to the present invention is shown. The electrical connector 100 could be mounted on an exterior substrate and mated with modular plugs. The electrical connector 100 has an insulative housing 1, a row of contact modules 2, a plurality of indicating assemblies, a row of shielding wafer 3, and a shielding shell 4.

The insulative housing 1 has a front wall 11 extending vertically along a transverse direction, a top wall 13 extending horizontally along the front-to-back direction, a lower wall 12 for mounting to the exterior substrate, and a pair of side walls 14 extending vertically along the front-to-back direction. The insulative housing 1 defines a row of receptacles (or mating ports) 15 for receiving modular plugs and a mounting port 16 disposed behind the mating ports 15. The mating ports 15 are recessed from the front wall 11 along the front-to-back direction. The mounting port 16 connects with the mating ports 15 through a plurality of spaced grooves 17. The side wall 14 defines two side slot 141 recessed therefrom.

The contact modules 2 are assembled to mounting port 16 along a back-to-front direction. The contact module 2 includes a horizontal printed circuit board (PCB) 22, a plurality of mating contacts 21 each having a contacting portion 211 extending into the mating port 15 and a connecting portion 213 connecting with the PCB 22, and a plurality of footer contacts 23 each including a top portion 231 connected with the PCB 22 and a lower tail portion 233 exposed outside of the insulative housing 1. The PCB 22 has a front portion 221 connected with connecting portions 213 of the mating contacts 21, a rear portion 223 connecting with the top portions 231 of the footer contacts 23, and a middle portion 222 with two rows of conductive pads 2221 for connecting with isolated transformers or common mode chokes (not shown). The front portion 221 defines a plurality of first soldering holes 2213 for mating contacts 21 inserting therein. The rear portion 223 defines a plurality of second soldering holes 2233 for footer contacts 23 inserting therein. The contact module 2 comprises an insulative carrier 24 disposed horizontally along the front-to-back direction for the PCB 22 mounted thereon. The insulative carrier 24 has a front section 241 for retaining the mating contacts 21, a rear section 243 for retaining the footer contacts 23, and a cavity 242 opening upwardly and located between the front section 241 and the rear section 242. The front section 241 has a plurality of first retaining slot 2411 extending along a top-to-bottom direction for retention of the mating contacts 21. The rear section 243 has a plurality of second retaining slot 2431 for retention of the footer contacts 23. The middle portion 222 of the PCB 22 defines two side slots 2224. The carrier 24 has two position posts 245 extending upwardly for inserting in the two side slots 2224 respectively.

The indicating assemblies includes a first indicating assembly 5 and a second indicating assembly 6 for indicating the communication status of one mating port 15. The first indicating assembly 5 includes a first light pipe 51 extending along the front-to-back direction and a first light emitting diode (LED) 52 extending along the top-to-bottom direction. The first light pipe 51 has a first front portion 511 exposed at a visible position, a first tail portion 512 for interacting with a first top face 520 of the first LED 52, and a first middle portion 513 connecting with the first front portion 511 and the first tail portion 512. The first middle portion 513 has a first front barb 5131 and a first rear barb 5133 protruding upwardly from a top wall of the middle portion 513. The first LED 52 has a plurality of first pins 522 for mounting onto the exterior substrate and a first light emitting portion or head portion 521 including the first top face 520.

The second indicating assembly 6 includes a second light pipe 61 extending along the front-to-back direction and a second LED 62 extending along the top-to-bottom direction. The second light pipe 61 has a second front portion 611 exposed at a visible position, a second tail portion 612 for connecting with a second top face 620 of the second LED 62, and a second middle portion 613 connecting with the second front portion 611 and the second tail portion 612. The second middle portion 613 has a second front barb 6131, a second rear barb 6133 protruding upwardly from a top wall of the middle portion 513, and a second side barb 6132 protruding transversely from an inner side wall of the second middle portion 613. The second LED 62 has a plurality of second pins for mounting onto the exterior substrate and a second light emitting portion including the second top face 620.

The top wall 13 defines two passageways 131 for the first light pipe 51 and the second light pipe 61 inserting therein, a plurality of slots 132 each disposed between two adjacent mating ports 15 for the shielding wafers 2 mounting respectively, two retaining opening 133 extending along a top-to-bottom direction for retention of the first front barb 5131 and the second front barb 6131 respectively. The two passageways 131 are located above the mating ports 15.

The first light emitting portion 521 has a plurality of first surrounding walls 5211 over molded with a first opaque layer 71. The second light emitting portion has a plurality of second surrounding walls over molded with a second opaque layer 72. The first light emitting portion 521 defines no opaque layer enclosing the first top face 520. The second light emitting portion defines no opaque layer enclosing the second top face 620. The first LED 52 and the second LED 62 emit different colors of light. The first LED 52 and the second LED 62 are disposed behind the PCB 22. Both of the first pins 522 and the second pins include a first side pin 81, a second side pin 83, and a central pin 82 located therebetween. The rear section 243 of the carrier 24 defines a plurality of through holes 2432 extending along the top-to-bottom direction. The second side pin 83 is shorter than the first side pin 81 along the top-to-bottom direction. Only the first side pin 81 and the central pin 82 inserted into the holes 2432 respectively.

The shielding shell 4 encloses the insulative housing 1 and the contact module 2. The shielding shell 4 is used for shielding electrical magnetic interference (EMI) from exterior environment.

Each shielding wafer 3 includes an insulative part 30 and a metal plate 31 insert molded within the insulative part 30. The metal plate 31 has a retention rib 311 extending along a transverse direction for retention of a top shell 41 of the shielding shell 4. The shielding wafer 3 is used for shielding electrical magnetic interference (EMI) between two adjacent mating ports 15.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a mating port for insertion of a plug connector, the mating port extending along a front-to-back direction;

a first indicating assembly for indicating a communication status of the mating port, the first indicating assembly including a first light pipe extending along the front-to-back direction and a first light emitting diode (LED) extending along a top-to-bottom direction, the first light pipe having a first front portion exposed at a visible position and a first tail portion for interacting with a first top face of the first LED, the first LED having a plurality of first pins for mounting onto an exterior substrate and a first light emitting portion including the first top face; and a second indicating assembly for indicating another communication status of the mating port, the second indicating assembly including a second light pipe extending along the front-to-back direction and a second LED extending along the top-to-bottom direction, the second light pipe having a second front portion exposed at a visible position and a second tail portion for interacting with a second top face of the second LED, the second LED having a plurality of second pins for mounting onto the exterior substrate and a second light emitting portion including the second top face; wherein the first light emitting portion has a plurality of first surrounding walls over molded with a first opaque layer, further comprising an insulative housing having a mounting port located behind the mating port and a contact module mounted into the mounting port, the contact module including a printed circuit board (PCB), a plurality of mating contacts each having a contacting portion extending into the mating port and a connecting portion connecting with the PCB, and a plurality of footer contacts each including a top portion connected with the PCB and a lower tail portion exposed outside of the insulative housing, the PCB having a front portion connected with the mating contacts and a rear portion connected with the footer contacts, the first LED and the second LED being disposed behind the PCB, wherein the contact module comprises an insulative carrier disposed horizontally along the front-to-back direction, and the PCB is mounted on the insulative carrier, the insulative carrier having a front section for retaining the mating contacts, a rear section for retaining the footer contacts, and a cavity opening upwardly and located between the front section and the rear section, said rear section having a plurality of through holes extending along the top-to-bottom direction, at least some of the first and second pins inserting into the holes, wherein the first pins include a first side pin, a second side pin, and a central pin located therebetween, the second side pin is shorter than the first side pin along the top-to-bottom direction, only the first side pin and the central pin inserted into the holes respectively.

2. The electrical connector as claimed in claim 1, wherein the second light emitting portion has a plurality of second surrounding walls over molded with a second opaque layer.

3. The electrical connector as claimed in claim 2, wherein said first top face is free of any opaque layer, and said second top face is free of any opaque layer.

4. The electrical connector as claimed in claim 1, wherein the first LED and the second LED emit different colors of light.

5. The electrical connector as claimed in claim 1, wherein said insulative housing includes a row of mating ports and a plurality of shielding wafers each disposed between two adjacent mating ports.

6. The electrical connector as claimed in claim 1, wherein said insulative housing has a front wall recessed therefrom along the front-to-back direction and two passageways located above the mating port for the first and second light pipes to insert thereinto.

7. The electrical connector as claimed in claim 1, further comprising a shield shell enclosing the insulative housing.

8. An electrical connector comprising:

a body defining a mating port extending through a front face thereof to be forwardly exposed to an exterior;

a printed circuit board located behind the mating port; and a pair of indicating assemblies side by side arranged with each other with therebetween a distance similar to a width of said mating port, each including a light emitting diode (LED) mounted upon the printed circuit board, and a light pipe having one external end exposed upon the front face and an inner end intimately contacting a light emitting portion of the LED; wherein at least one of said pair of indicating assemblies has the light emitting portion equipped with an opaque layer thereon circumferentially except a face coupling to the inner end of the light pipe, further comprising an insulative housing having a mounting port located behind the mating port and a contact module mounted into the mounting port, the contact module including a printed circuit board (PCB), a plurality of mating contacts each having a contacting portion extending into the mating port and a connecting portion connecting with the PCB, and a plurality of footer contacts each including a top portion connected with the PCB and a lower tail portion exposed outside of the insulative housing, the PCB having a front portion connected with the mating contacts and a rear portion connected with the footer contacts, the first LED and the second LED being disposed behind the PCB, wherein the contact module comprises an insulative carrier disposed horizontally along the front-to-back direction, and the PCB is mounted on the insulative carrier, the insulative carrier having a front section for retaining the mating contacts, a rear section for retaining the footer contacts, and a cavity opening upwardly and located between the front section and the rear section, said rear section having a plurality of through holes extending along the top-to-bottom direction, at least some of the first and second pins inserting into the holes, wherein the first pins include a first side pin, a second side pin, and a central pin located therebetween, the second side pin is shorter than the first side pin along the top-to-bottom direction, only the first side pin and the central pin inserted into the holes respectively.

9. The electrical connector as claimed in claim 8, wherein light spread from the face of said light emitting portion of one of said pair of indicating assemblies is different from that from the face of the light emitting portion of the other of said pair of indicating assemblies.

10. The electrical connector as claimed in claim 8, wherein the opaque layer is thin so that the corresponding light emitting portion keeps a similar dimension as original.

11. The electrical connector as claimed in claim 8, wherein the body defines passageway to receive the corresponding light pipes, respectively.

12. The electrical connector as claimed in claim 8, wherein both said pair of indicating assemblies are equipped with the opaque layers on the light emitting portions of the corresponding LEDs.

13. The electrical connector as claimed in claim 8, wherein said face is a top face of the light emitting portion opposite to the printed circuit board.

* * * * *